United States Patent [19]

Metz

[11] 3,990,294

[45] Nov. 9, 1976

[54] SMELTING SYSTEM FOR INCREASED LINING SERVICE OF REFINING VESSELS

[75] Inventor: Paul Metz, Luxembourg, Luxemburg

[73] Assignee: Aciéries Réunies de Burbach-Eich-Dudelange S.A. ARBED, Luxembourg, Luxemburg

[22] Filed: Nov. 25, 1974

[21] Appl. No.: 526,715

[30] Foreign Application Priority Data

Nov. 30, 1973 Luxemburg ..... 68905

[52] U.S. Cl. ..... 75/50; 75/61; 266/281

[51] Int. Cl.[2] ..... C21C 7/00

[58] Field of Search ..... 75/46, 50–57, 75/59–61, 24, 30; 266/42, 43, 37, 38, 280, 281

[56] References Cited

UNITED STATES PATENTS

| | | | |
|---|---|---|---|
| 2,862,811 | 12/1958 | Eketorp | 75/61 X |
| 3,005,628 | 10/1961 | Rinesch | 266/43 UX |
| 3,020,150 | 2/1962 | Reed | 266/42 |
| 3,599,953 | 8/1971 | Smith | 266/42 |
| 3,737,489 | 6/1973 | Murton | 266/43 |

*Primary Examiner*—M. J. Andrews
*Attorney, Agent, or Firm*—Karl F. Ross; Herbert Dubno

[57] ABSTRACT

A refining ladle provided with a refractory lining contains a liquid-steel melt topped by a layer of slag. Wear of the lining, which is principally concentrated at the region in contact with the slag is minimized by displacing the upper surface of the melt relative to the lining of the ladle or other smelting receptacle so as to spread this wear over a greater area. This displacement is effected by providing the ladle with a plurality of throughgoing holes establishing different levels at which the melt surface is held for predetermined regular intervals. It is also possible to rotate the ladle continuously or discontinuously about its longitudinal axis. A hardenable patching material may be sprayed against a portion of the ladle lining when this portion is exposed by displacement of the melt and slag therein.

6 Claims, 4 Drawing Figures

SMELTING SYSTEM FOR INCREASED LINING SERVICE OF REFINING VESSELS

CROSS-REFERENCE TO RELATED APPLICATION

This application is related to my copending application Ser. No. 508,695 filed on Sept. 23, 1974 for a METHOD OF PRODUCING STEEL now abandoned. That application in turn is related to copending application Ser. No. 471,895 filed on May 21, 1974.

FIELD OF THE INVENTION

The present invention relates to a method of refining steel. More particularly this invention concerns a method of prolonging the service life of the refractory lining in a steel-smelting plant.

BACKGROUND OF THE INVENTION

Steel is usually refined in a vessel called a crucible in which it is held in a liquid state while the composition of the steel is corrected. The top of the steel melt in the ladle is covered with a layer of slag. The ladle is lined with a refractory lining that prevents the molten steel from coming in contact with the steel shell of the crucible and which takes part in the refining operation. The principal obstacle to operating the same ladle continuously for, for example, several days is the wear of this refractory lining since, once the lining is reduced in thickness it must be renewed to prevent the steel melt from coming into direct contact with the metal shell. The refractory lining wears principally in regions in which it comes into contact with the slag on top of the melt, the remainder of the refractory lining having a much longer service life.

It has been suggested to increase the service life of these refractory linings by periodically locally renewing them in the regions of greatest wear. This is carried out by spraying or projecting refractory material in the worn spots and allowing it to harden. Such operations require that a complete halt be made to the refining operation and that the ladle in question be emptied completely for it to be carried out.

It has also been suggested to include in the refining slag, limestone and dolomite so as to saturate the slag in magnesium oxide and thereby considerably reduce its corrosivity. In practice the pulverized dolomite is added to the limestone blown by lances into the melt. According to this process the corrosivity of the slag is reduced considerably, however the refractory lining still wears considerably more in the region of the slag than elsewhere so that it must be renewed at this location when the remainder of the refractory lining is still in excellent condition.

OBJECTS OF THE INVENTION

It is therefore an object of the present invention to provide an improved method of treating molten steel.

Yet another object is to provide a method of increasing the service life of the refractory lining in a steel-smelting ladle or like recipient.

Yet another object is to provide an improvement in the steel smelting method wherein the service life of the refractory lining is increased considerably, and therefore the productivity of the smelting system is increased.

SUMMARY OF THE INVENTION

These objects are attained according to the present invention by periodically relatively displacing the corrosive medium, here the slag, and the wall of all or part of the ladle containing the slag in order to decrease the local wear by spreading this wear out over a larger surface.

According to a feature of this invention this relative displacement is effected by varying the fill level of the ladle, that is the volume of the melt constituting the fused metal and the liquid slag, according to a predetermined program. Thus in accordance with the present invention there can be several distinct levels at which the melt is maintained successively for a long period during the smelting operation.

According to the present invention it has been found to be advantageous not to prolong the periods of contact extensively, but to repeat exposures or residence at different levels. Thus it is possible to vary the volume of the melt at a given frequency between a level of maximum filling and a level of minimum filling. It is also possible to subject the melt to an oscillating movement.

In this manner the zone of contact between the slag and the lining of the ladle is displaced either continuously or periodically such that the wear is not limited to a single region but is spread evenly during several exposure periods over a much larger surface.

In accordance with another feature of this invention the zones of maximum wear are displaced during the smelting by rocking all or part of the apparatus or rotating it partially relative to one of its axes. In this manner it is possible to displace the exposure zones either progressively and continuously or periodically according to a predetermined frequency so as best to balance the wear.

During a continuous smelting operation the surface of the slag is thus according to this invention dropped to a maximum extent either over the entire height of the contact zone of the lining as the filling volume is varied or on one side of the lining as the ladle reaches one end of the rocking or rotating movement. The greater part of the wear zone is periodically uncovered and is thus readily accessible so as to be renewed by spraying thereagainst refractory material in the form of a Gunite-type mixture. According to the present invention this is carried out at the minimal filling level or the corresponding phase which is not normally obtained during the refining operation but only when there is a necessity of carrying out either an inspection of the entire wear zone or a repair of this zone. Such repairs or renewals thus become possible simply by stopping the refining operation without necessarily emptying the ladle.

Thus in accordance with the present invention it is possible to avoid the concentration of wear at particular regions of the lining and it is also possible in accordance with this invention to repair these worn regions without a relatively long downtime for the system and without emptying the ladle. Thus it is possible to prolong greatly the duration of a continuous refining operation before it is necessary to empty the ladle and replace the complete lining.

BRIEF DESCRIPTION OF THE DRAWING

The above and other objects, features, and advantages of the invention will become more readily apparent from the following, description reference being made to the accompanying drawing in which.

SPECIFIC DESCRIPTION

Figure 1:
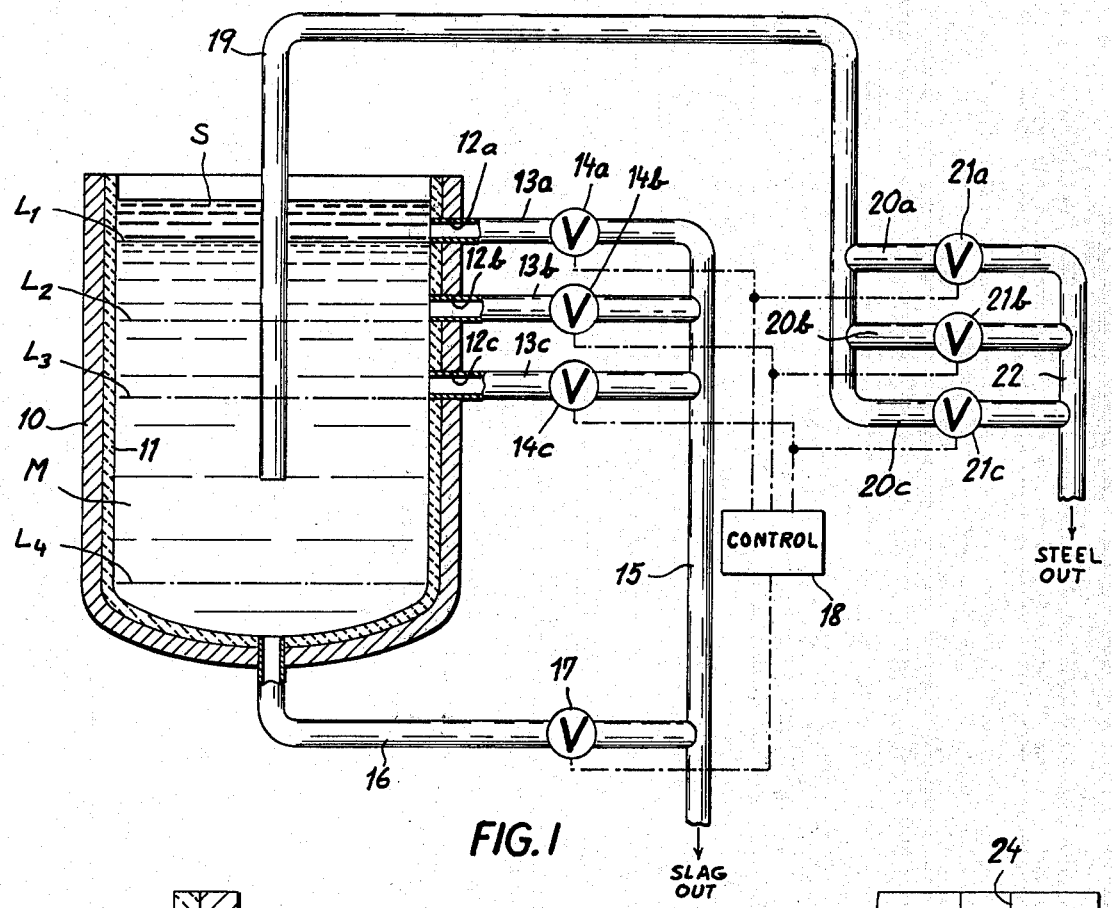
FIG. 1 is a diagrammatic sectional view of a system in accordance with this invention.

As shown in FIG. 1 a ladle 10 is provided with a refractory lining 11 in which is carried a steel melt M topped by a layer of slag S. The ladle 10 and its lining 11 are formed with three vertically spaced throughgoing holes 12*a*, 12*b*, and 12*c* which define respective levels $L_1$, $L_2$, and $L_3$ for the top of the melt M. Conduits 13*a* – *c* are connected to these holes 12*a* – *c* and provided with respective valves 14*a* – *c* so that depending on which valve is opened the level of the melt M is established. All of these valves 14*a* – *c* are connected to a single outlet pipe 15 from which slag is drained. In addition a siphon pipe 19 extending down into the lower portion of the ladle 10 has a plurality of branch conduits 20*a* – *c* slightly below the levels L 1 – 3 and connected via valves 21*a* – *c* to an outlet conduit 22 through which molten steel is emptied. A programmed controller 18 is connected to all of the valves 14*a* – *c* and 21*a* – *c* so as to control the amounts of steel and slag that are drained off periodically to vary the level in the ladle 10 and thereby prevent excessive wear at any one level L 1 – 3.

In addition there is provided at the bottom of the ladle 10 an outlet conduit 16 provided with a respective valve 17 connecting this conduit 16 to the outlet conduit 15 so that the level in the melt may be dropped to a level $L_4$ for inspection of the entire wear region and renewal thereof by means of a Gunite spray or the like. This valve 17 is only opened by the control 18 when it is necessary to inspect or renew the lining 11, but in normal operation the level is varied between levels L 1 – 3 periodically.

Figure 2:
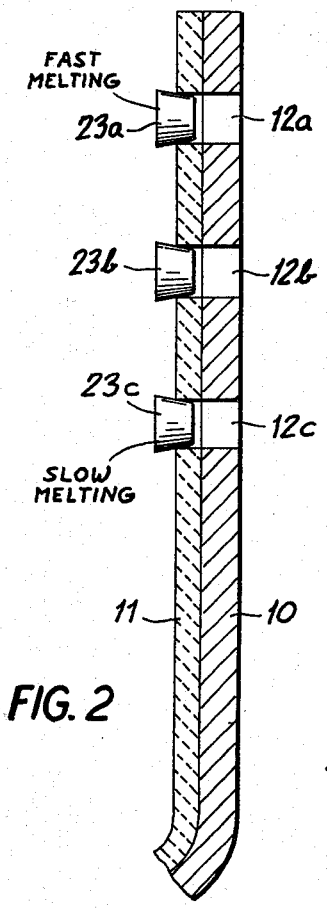
FIG. 2 is a sectional view of a detail of the ladle in accordance with this invention.

The proportions of slag and steel that are drained off at a single time as the level is changed depend on the refining process. FIG. 2 shows an arrangement wherein the three holes 12*a*, 12*b*, and 12*c* of the ladle 10 are fitted with respective plugs 23*a*, 23*b*, and 23*c*. The plug 23*a* melts at a faster rate than the plug 23*b* which in turn melts at a faster rate than the plug 23*c*. This melting rate is determined by mixing a material such as sawdust with the refractory material from which the plugs are made. It is also possible to employ an additive which merely lowers the fusion plugs of these points. Once the lowest level $L_3$, when the ladle is approximately one-third full, is obtained the plugs 23*a* – *c* are replaced and more steel is added so that again the level rises to the upper level $L_1$ and then drops successively as the plugs fuse.

Figure 3:
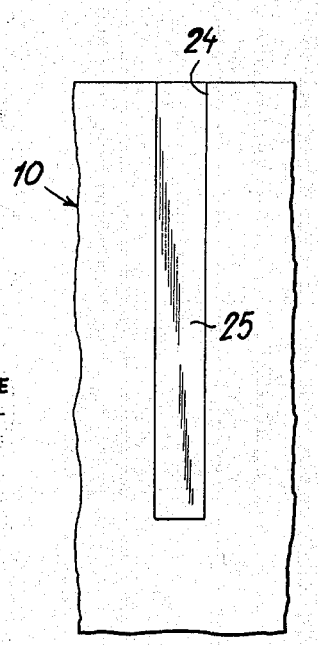
FIG. 3 is an elevational view of a portion of a ladle according to this invention.

It is also possible as is shown in FIG. 3 to employ a ladle 10′ formed in its wall with a vertical slot 24 in which is provided a fusable element 25 which is of a lower melting temperature at the top than at the bottom so that it slowly disintegrates from the top to the bottom and causes the level in the ladle to drop.

Figure 4:
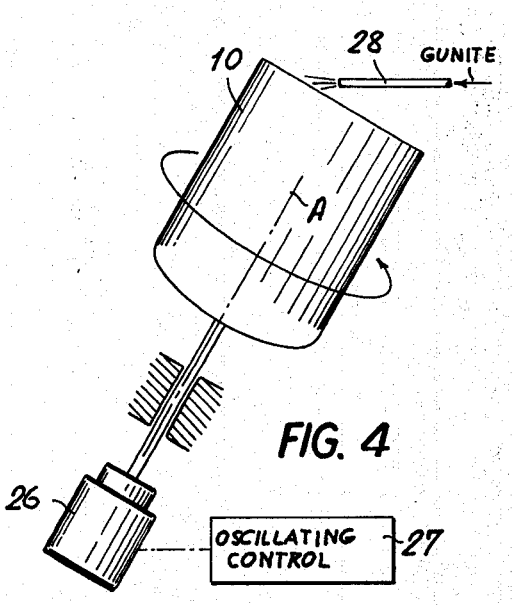
FIG. 4 is a perspective diagrammatic view of yet another arrangement in accordance with the present invention.

It is also possible in accordance with the present invention to displace the melt and the ladle relatively without changing the volume of the melt in the ladle. This is shown in FIG. 4 where the crucible 10 is rotated in fixed angular increments about an axis A which is central to the crucible 10 but nonvertical. A motor 26 controlled by a programmer 27 effects this rotary movement which is, in accordance with the present invention a rocking type of movement, 180° in one direction, then 180° in the opposite at predetermined intervals. In addition an injector nozzle 28 is provided for spraying a Gunite-type mixture against the exposed and worn portions of the ladle lining. For inspection operations or repair operations it is possible to provide an extreme position in the two rotational senses. In any case this system is completely automated.

The method according to the present invention serving to increase the service life of the ladle lining can be adapted to oxidation-type or reduction-type continuous refining operations in which a separate vessel or ladles, compartmented vessels or ladles, or coupled ladles or the like are used.

I claim:

1. In a continuous refining process wherein a steel melt topped by a layer of slag is maintained continuously in a upwardly open vessel provided with a refractory lining so that the slag layer contacts said lining and quantities of steel are withdrawn from the vessel and replaced with molten metal during the continuous refining process, the improvement which comprises distributing the wear of the refractory lining by alternately moving the upper surface of the slag layer and the upper surface of the steel melt in said vessel upwardly and downwardly along said lining during the continuous refining process and prior to any emptying of the vessel.

2. The improvement defined in claim 1 wherein the movement of the upper surface of the slag layer and the melt along the refractory lining is affected by varying the volume of the melt and slag in the vessel during the continuous refining process.

3. The improvement defined in claim 1 wherein the movement of the upper surfaces of the slag layer and melt along said refractory lining is effected periodically during continuous refining of said melt in said vessel.

4. The improvement defined in claim 1 wherein the movement of the upper surfaces of said slag layer and said melt along said refractory lining is effected by rotating said vessel about an axis thereof inclined to the vertical.

5. The improvement defined in claim 4 wherein said vessel is continuously rotated about said axis.

6. The improvement defined in claim 1 wherein a portion of said lining is exposed during the movement of said upper surfaces of said slag layer and melt along said lining, said method further comprising the step of spraying a hardenable lining-repair material onto said portion during continuous refining of said melt in said vessel.

* * * * *